US009673557B1

(12) United States Patent
Barnard

(10) Patent No.: US 9,673,557 B1
(45) Date of Patent: Jun. 6, 2017

(54) CABLE MANAGEMENT STRUCTURE

(71) Applicant: Brandon Barnard, Evansville, IN (US)

(72) Inventor: Brandon Barnard, Evansville, IN (US)

( * ) Notice: Subject to any disclaimer, the term of this patent is extended or adjusted under 35 U.S.C. 154(b) by 0 days.

(21) Appl. No.: 15/215,720

(22) Filed: Jul. 21, 2016

Related U.S. Application Data

(60) Provisional application No. 62/195,166, filed on Jul. 21, 2015.

(51) Int. Cl.
*H01R 13/506* (2006.01)
*H01R 31/06* (2006.01)
*H01R 13/58* (2006.01)

(52) U.S. Cl.
CPC ..... *H01R 13/506* (2013.01); *H01R 13/5833* (2013.01); *H01R 31/06* (2013.01)

(58) Field of Classification Search
USPC ..... 439/501, 131, 4, 35, 171
See application file for complete search history.

(56) References Cited

U.S. PATENT DOCUMENTS 6,457,984 B1 * 10/2002 Montgomery ..... H01R 13/518 439/131
6,517,380 B1 * 2/2003 Deutsch ..... H01R 13/746 439/598
6,790,062 B1 * 9/2004 Liao ..... H01R 13/72 439/171
6,971,883 B1 * 12/2005 Ridge ..... H01R 13/516 439/142
7,255,595 B2 * 8/2007 Lo ..... H01R 13/701 439/4
7,264,478 B1 * 9/2007 Downing ..... B65H 75/425 191/12.4
7,563,130 B2 * 7/2009 Farrar ..... B65H 75/06 320/111
7,959,444 B2 * 6/2011 Corless ..... H01R 13/72 439/35
8,043,100 B2 * 10/2011 Liao ..... H01R 27/00 439/131
9,407,048 B2 * 8/2016 George ..... H01R 13/72
2006/0261203 A1 * 11/2006 Yang ..... H02G 11/02 242/378.4

* cited by examiner

*Primary Examiner* — Alexander Gilman
(74) *Attorney, Agent, or Firm* — Gary K. Price

(57) ABSTRACT

A cable management structure for application with an electronic apparatus, such as an Apple Watch device. The cable management structure having a housing and a main body portion. The main body portion includes an interior for receiving a prior art power adapter of a magnetic charging cable, the charging cable in communication with openings on a front plate of the main body portion. The openings sized to receive the plug arrangement to couple the main body portion having the power adapter with a mains power supply. The main body portion further defines a horizontal neck that extends perpendicular to the front plate, and a recess adjacent the neck and sized for receiving the connector of the charging cable. The neck for manually winding the cable of the charging cable. In application, the electronic device rests on the structure in communication with the charging cable's connector, and the length of cable is wound around the neck with one end terminating at the connector disposed in the recess, and the opposite end of the cable terminating at the power adapter disposed in the interior of the main body portion to couple current from the mains power supply.

20 Claims, 6 Drawing Sheets

CABLE MANAGEMENT STRUCTURE

CROSS REFERENCES TO RELATED APPLICATIONS

U.S. Provisional Application for Patent No. 62/195,166, filed Jul. 21, 2015, with title "Cable Management Structure" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention is generally related to a casing structure for an electronic apparatus, and more particularly, to a casing structure for docking the electronic apparatus and managing a charging cable used for charging the electronic apparatus.

2. Brief Description of Prior Art

Portable electronic or informational devices, such as the Apple Watch, have become more and more popular in our daily life. An essential accessory to the electronic device is the charging cable used to maintain or charge the power of the electronic device. To recharge the battery in the electronic device, the battery is left within or attached to the device, and is recharged by means of a charging cable. The charging cable is coupled to a mains alternating current (AC) supply via a conventional plug arrangement that is coupled to the device's battery to be recharged.

A problem with these chargers is that the cable has a length that is inconvenient and often becomes entangled with other objects and is difficult to manage. The cable also commonly becomes tangled, which is both frustrating and time consuming to untangle.

Therefore, there is a need to provide a casing structure for docking the electronic device and managing the electronic device's charging accessory and the accessory's charging cable in order to prevent the cable from entangling with other objects and/or become entangled. It also needs to provide a casing structure which can be assembled easily and efficiently, and can rectify those drawbacks of the prior art and solve the above encountered problems.

SUMMARY OF THE INVENTION

A cable management structure for application with an electronic apparatus, such as an Apple Watch device. The cable management structure generally includes a housing and a main body portion. The main body portion includes an interior for receiving a prior art power adapter of a magnetic charging cable, the charging cable in communication with openings on a front plate of the main body portion. The openings sized to receive the plug arrangement to couple the main body portion having the power adapter with a mains power supply.

The main body portion further defines a horizontal neck that extends perpendicular to the front plate, and a recess adjacent the neck and sized for receiving the connector of the charging cable. The neck for manually winding the cable of the charging cable.

In application, the electronic device rests on the structure in communication with the charging cable's connector, the length of cable is wound around the neck with one end terminating at the connector disposed in the recess, and the opposite end of the cable terminating at the power adapter disposed in the interior of the main body portion to couple current from the mains power supply. The cable management structure is plugged into the mains supply and the cable connector is coupled with the electronic device's battery to be charged. When the cable is in application for charging, the cable remains wound around the horizontal neck such that during both application and storage, the cable is managed around the neck and will avoid becoming tangled and being entangled with other objects.

Figure 1:
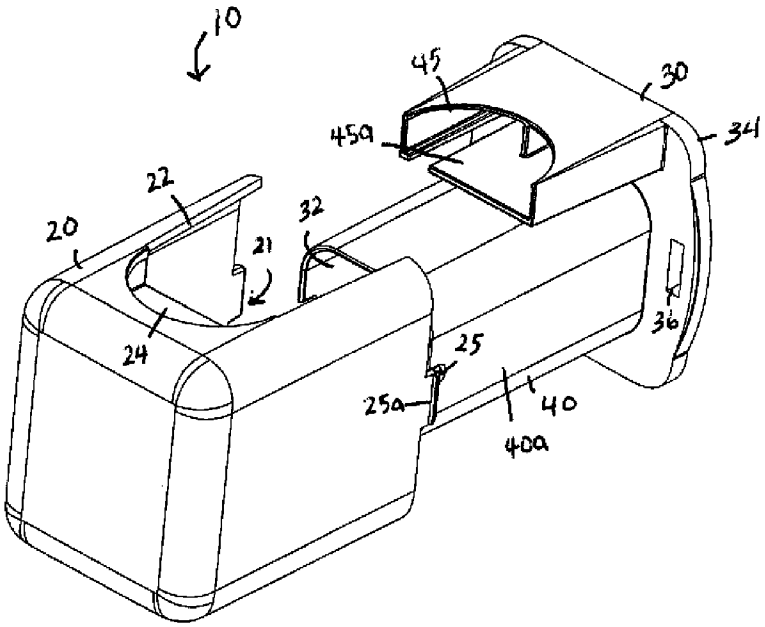
FIG. 1 is a first end exploded view of the present invention, a cable management structure for managing a charging cable.

The broken lines in the drawings show a prior art magnetic charging cable and are included for purposes of illustrating environmental subject matter and form no part of the present invention.

DESCRIPTION OF THE PREFERRED EMBODIMENT

The present invention is directed to a cable management structure for docking an electronic device and managing a charging cable accessory used to maintain or charge the power of the electronic device, such as the Apple Watch device. The present structure includes embodiments designed to manage the length of the charging cable accessory and avoid the cable from getting tangled and/or entangling with other objects, and provides a compact way of charging the electronic device. In the broadest context, the cable management structure of the present invention consists of components configured and correlated with respect to each other so as to attain the desired objective.

With the proliferation of electrical and electronic devices (which are considered devices herein), simple and universal methods of providing power and/or charging of these devices is becoming increasingly important. Among the many accessories available for these portable devices, are so-called "magnetic charging cables" that are used to maintain or charge the power of the electronic device.

Figure 5:
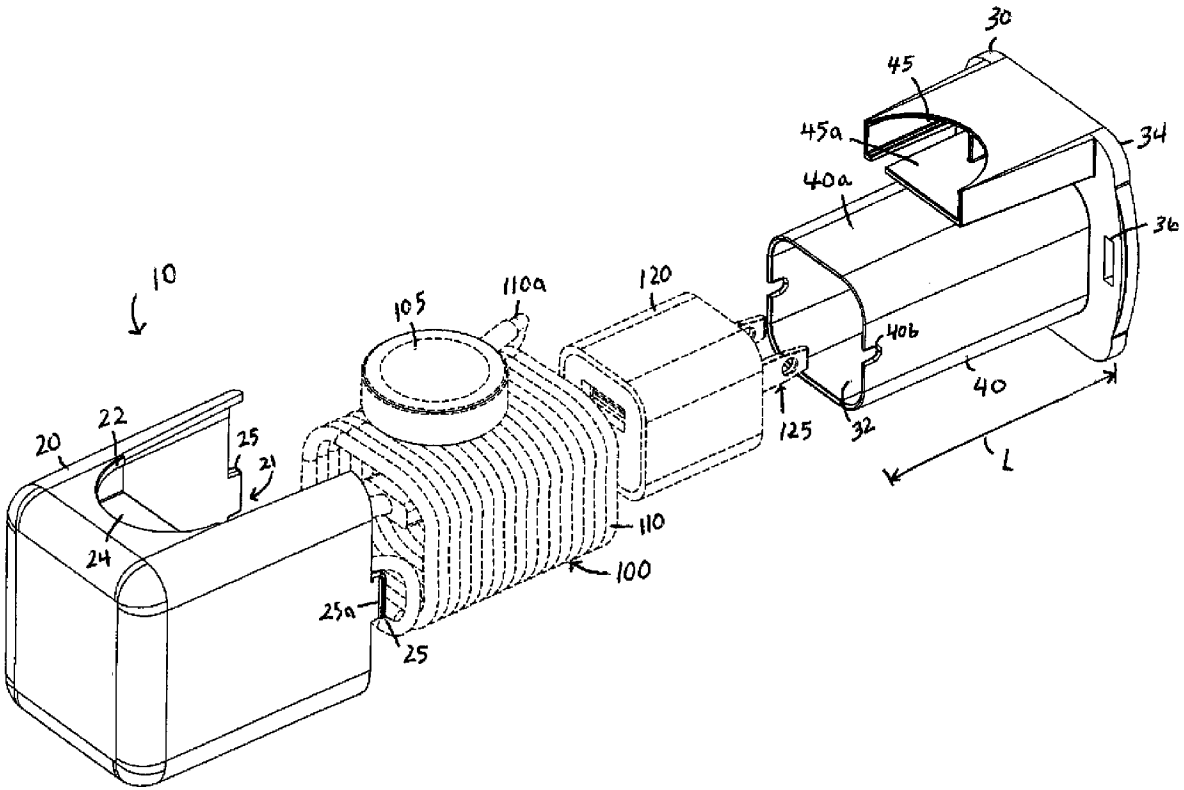
FIG. 5 is an exploded view of the present invention, with a magnetic charging cable used for charging an electronic device.

Referring to the drawings, a cable management structure 10 according to the preferred embodiment is shown. FIG. 5 is an exploded view of the structure 10 and further illustrates a prior art magnetic charging cable 100 including a connector 105, a cable 110 and a power adapter 120. As is known, during application, the power adapter 120 of the charging cable 100 is coupled to the AC supply via a plug arrangement 125 and the connector 105 is coupled to the device's battery to be recharged.

From the outset, it should be understood that the present invention relates solely to a device for docking an electronic device and managing the prior art charging cable accessory power source of the electronic device. The present invention does not alter the known application of the prior art charging cable 100 nor does it alter the process of charging the portable electronic device. However, as will be described, the present invention eliminates the known difficulties associated with managing the charging cable 100 during application.

The cable management structure 10 generally includes a housing 20 and a main body portion 30. The housing 20 and main body portion 30 made of a plastic material in a known manner.

Figure 6:
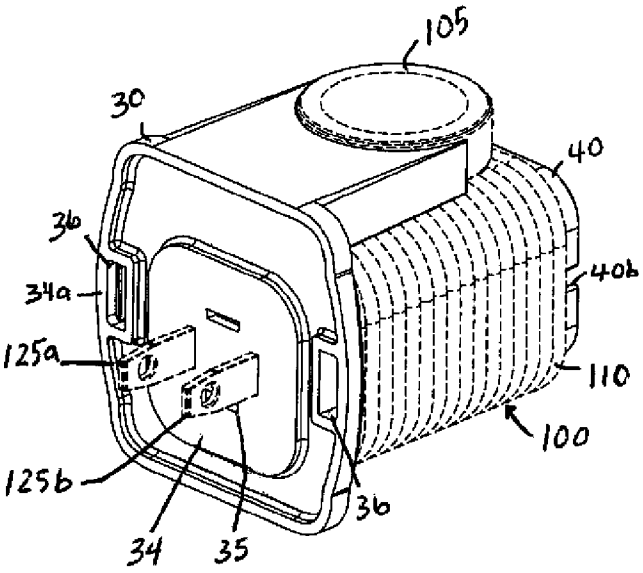
FIG. 6 is a front view of the main body portion of the present invention, further showing the magnetic charging cable.

The main body portion 30 includes a continuous side wall 40 that defines an interior 32 adapted to receive the power adapter 120 of the magnetic charging cable 100 and is in communication with openings 35 on a front plate 34 of the main body portion 30. The openings 35 sized to receive the plug arrangement 125 for coupling, for example, with a wall socket to couple the main body portion 30 with the power adapter 120 as described to a mains power supply. In the embodiment shown in FIG. 6, the pins 125*a*, 125*b* are those for the U.S. mains supply, but may equally well be of the three-pin type for the U.K. or any other known pin arrangement.

The continuous sidewall 40 is a horizontal neck that extends perpendicular to the front plate 34. The main body portion 30 further includes a recess 45 that is preferably parallel to and adjacent the sidewall 40, and extends from the front plate 34, and is sized and shaped for receiving a portion of the connector 105 of the charging cable 100. The recess 45 having a configuration such that when a portion of the connector 105 is received on a surface 45*a* therein, the connector 105 is secured but exposed for coupling to the electronic device's battery to be recharged.

As illustrated, the neck 40 generally defines a length L (see FIG. 5) that serves as a fixed "reel" on which the cable 110 of the charging cable 100 can be manually wound. Neck 40 having an outer surface 40*a* and preferrably a generally elongated circular configuration around which the length of the cable 110 is manually wound. As illustrated, the neck 40, and more particularly, the defined interior 32 is sized and shaped for housing the power adapter 120.

As should now be understood, the length of cable 110 is manually wound around the outer surface 40*a* of the neck 40 with one end 110*a* appropriately connected at the connector 105 disposed in the recess 45, and the opposite end (not shown) of the cable 110 connected at the power adapter 120 disposed in the interior 32 of the main body portion 30 to couple current from the mains power supply through the pins to the electronic device. The neck 40 further includes at least one side notch 40*b* that defines a path to direct the opposite end 110*b* of the cable 110 from the outer surface 40*a* of the neck 40 to the power adapter 120.

Figure 2:
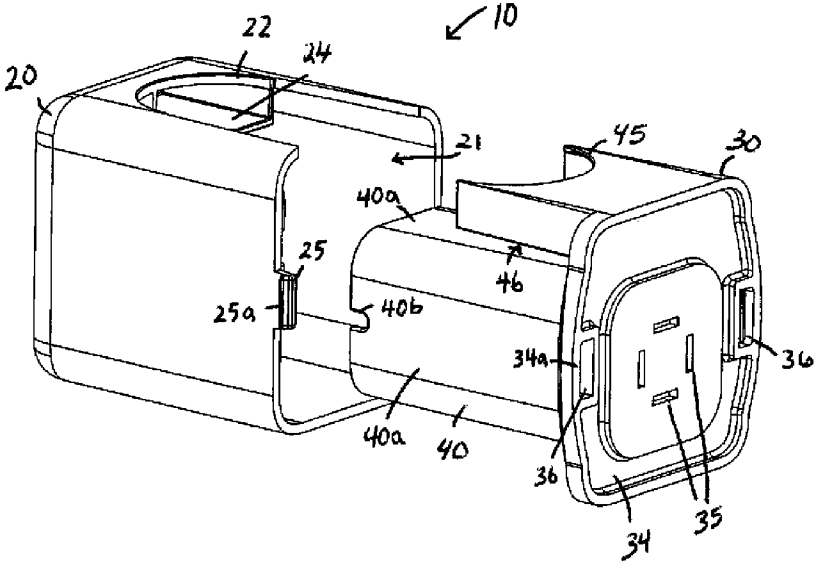
FIG. 2 is an opposite end exploded view of the structure of FIG. 1
Figure 3:
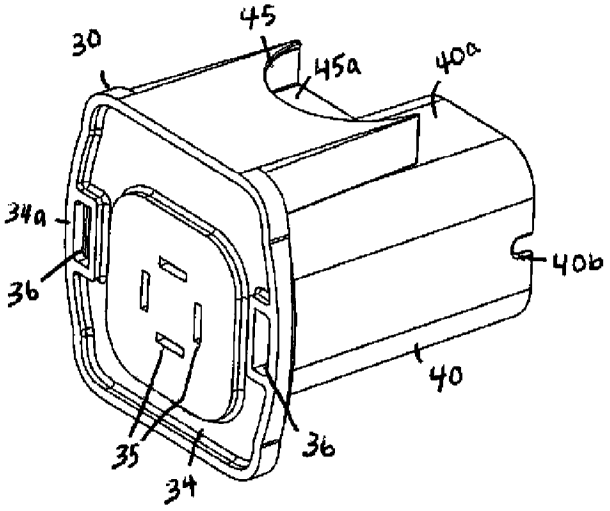
FIG. 3 is a front view of the main body portion of the structure of FIG. 1.
Figure 4:
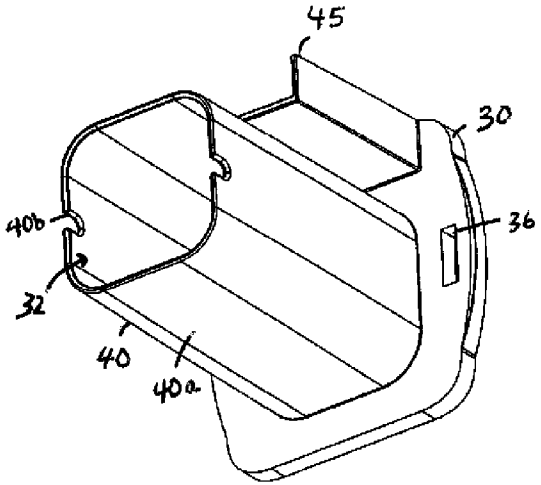
FIG. 4 is a back view of the main body portion of the structure of FIG. 1.

As best shown in FIG. 2, there is a spacing 46 between the outer surface 40*a* of the neck 40 and recess 45 in order to continue wrapping the cable 110 along the neck between the neck and the recess.

In use, the cable management structure 10 is plugged into the mains supply using the external pins 125A, 125B and the cable connector 105 coupled with the device's battery to be recharged. When the cable 110 is in application for recharging, the cable 110 remains wound around the neck 40 as described such that during both application and storage, the cable is managed around the neck 40 and will avoid becoming tangled and being entangled with other objects.

As illustrated, the housing 20 defines a cavity 21 that is sized for receiving the continuous sidewall 40 of the main body portion 30. The housing 20 further includes a U-shaped notch 22 sized for receiving the recess portion 45 of the main body portion 30, and a ledge 24. As described, the recess portion 45 is sized and configured to receive a portion of the connector 105. In application, the balance of the connector 105, not received within the recess 45 rests on the ledge 24.

The housing 20 further includes at least one end catch 25 that is sized and shaped, and aligned to be received through side aperture 36 disposed on front plate 34. In application, catch 25 is received through side aperture 36 so that an edge 25*a* of catch 25 rests against the outer surface 34*a* of front plate 34, releasably connecting main body portion 30 with housing 20.

As should be understood, the housing 20 does not participate in the recharging process of the electronic device's battery as does the main body portion 30. The main objective of the housing 30 is to secure and maintain the components of the charging cable 100, including the charging cable 100, with the main body portion 30 as described. More particularly, the housing 20 assists the main body portion 30 position and manage the power adapter 120, and connector 105 as described, and maintain the cable 110 wound around the neck 40 during both application and storage.

The present invention provides a cable management structure for docking the electronic device and managing the charging cable used for charging the electronic device. The cable management structure disclosed in the above-mentioned embodiments maintains each of the components of a charging cable, namely the connector, the cable, and the power adapter, and teaches a way to avoid the cable from becoming tangled or entangled with other objects, thereby resolving the drawbacks of the prior art. In addition, the cable management structure of the present invention is manufactured easily and efficiently, without great expense. Accordingly, the present invention possesses many outstanding characteristics, effectively improves upon the drawbacks associated with the prior art in practice and application, produces practical and reliable products, bears novelty, and adds to economical utility value.

Although the above description contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A cable management structure comprising:

a housing, a body portion, said body portion includes a continuous side wall, an end, and a recess, wherein said continuous side wall defines an interior adapted for receiving a power adapter of a magnetic charging cable, and wherein said end includes openings sized for receiving the power adapter's plug arrangement for coupling to a mains power supply, and said recess sized and shaped for receiving a connector of the magnetic charging cable, wherein said housing configured for releasably receiving said continuous sidewall and further defines a notch having a ledge, wherein said notch for receiving said recess.

2. The cable management structure of claim 1, wherein said continuous side wall having a generally elongated circular configuration.

3. The cable management structure of claim 2, wherein a cable of the magnetic charging cable is wound around an outer surface of said continuous side wall and one end of the cable is attached at the connector positioned in said recess and an opposite end of the cable is attached at the power adapter received in the interior of the continuous side wall.

4. The cable management structure of claim 3, wherein said continuous side wall further includes a side notch that defines a path to direct the opposite end of the cable from said outer surface to the power adapter.

5. The cable management structure of claim 4, further including a spacing disposed between said outer surface and said recess.

6. The cable management structure of claim 1, wherein said housing further includes an end catch configured to be received through an aperture in said end for releasably connecting said body portion to said housing.

7. The cable management structure of claim 1, wherein said recess receives a first portion of the connector, and a second portion of the connector rests on said ledge.

8. A cable management structure comprising:

a housing, a body portion, said body portion includes a continuous side wall, a front end, and a recess, wherein said continuous side wall defines an interior adapted for receiving a power adapter of a magnetic charging cable, and wherein said front end includes openings sized for receiving the power adapter's plug arrangement for coupling to a mains power supply, and said recess sized and shaped for receiving a connector of the magnetic charging cable, wherein said housing defines a cavity sized for receiving said continuous sidewall and further defines a notch having a ledge, wherein said defined notch for receiving said recess.

9. The cable management structure of claim 8, wherein said continuous side wall having a generally elongated circular configuration.

10. The cable management structure of claim 9, wherein said continuous sidewall extends perpendicular to said front end.

11. The cable management structure of claim 10, wherein a cable of the magnetic charging cable is wound around an outer surface of said continuous side wall and one end of the cable is appropriately attached at the connector positioned in said recess and an opposite end of the cable is attached at the power adapter disposed in the interior of the continuous side wall.

12. The cable management structure of claim 11, wherein said continuous side wall further includes a side notch that defines a path to direct the opposite end of the cable from said outer surface to the power adapter.

13. The cable management structure of claim 12, further including a spacing between said outer surface and said recess.

14. The cable management structure of claim 8, wherein said housing further includes an end catch configured to be received in a side aperture of said front end for releasably connecting said body portion to said housing.

15. The cable management structure of claim 8, wherein said recess receives a first portion of the connector, and a second portion of the connector rests on said ledge.

16. A cable management structure comprising:

a housing, a body portion that is releasably connected to said housing, said body portion includes a continuous side wall that defines an interior adapted for receiving a power adapter of a magnetic charging cable, said body portion further including a front plate having openings sized for receiving the power adapter's plug arrangement for coupling to a mains power supply, and a recess sized and shaped for receiving a first portion of a connector of the magnetic charging cable, said continuous side wall having an outer surface, a spacing between said outer surface and said recess such that a length of a cable of the magnetic charging cable can be wound around said outer surface, wherein said housing defines a cavity sized for receiving said continuous sidewall and further defines a notch having a ledge, and wherein said notch sized for receiving said recess portion and wherein a second portion of the connector rests on said ledge.

17. The cable management structure of claim 16, wherein said continuous side wall having a generally elongated circular configuration.

18. The cable management structure of claim 17, wherein the length of the cable is wound around said outer surface and one end of the cable is appropriately attached at the connector positioned in said recess and an opposite end of the cable is attached at the power adapter positioned in the interior of the continuous side wall.

19. The cable management structure of claim 18, wherein said continuous side wall further includes a side notch that defines a path to direct the opposite end of the cable from said outer surface to the power adapter.

20. The cable management structure of claim 16, wherein said housing further includes a catch that cooperates with an aperture of said front plate, said catch and aperture configured for releasably connecting said body portion to said housing.

* * * * *